United States Patent [19]

Söderström

[11] 4,444,416

[45] Apr. 24, 1984

[54] VEHICLE

[76] Inventor: Berry Söderström, Box 13, S-814 01 Skutskär, Sweden

[21] Appl. No.: 539,638

[22] Filed: Oct. 7, 1983

Related U.S. Application Data

[63] Continuation of Ser. No. 299,032, Aug. 31, 1981, abandoned.

[30] Foreign Application Priority Data

Jan. 9, 1980 [SE] Sweden ..... 7910706

[51] Int. Cl.[3] ..... B66C 5/00

[52] U.S. Cl. ..... 280/763.1; 212/189; 280/6 H

[58] Field of Search ..... 280/763, 766, 764, 6 H, 280/6 R, 6.1; 298/17 T, 17 SG; 212/189, 182

[56] References Cited

U.S. PATENT DOCUMENTS

| | | | |
|---|---|---|---|
| 2,864,625 | 12/1958 | Clements | 280/639 |
| 3,638,965 | 2/1972 | Cassady | 280/764 |
| 3,912,289 | 10/1975 | Czajkowski, Jr. | 280/6.1 |
| 4,137,994 | 2/1979 | Wood | 280/6 R |
| 4,202,453 | 5/1980 | Wilkes, Jr. et al. | 180/235 |
| 4,226,331 | 10/1980 | Dumond | 212/189 |

FOREIGN PATENT DOCUMENTS

| | | | |
|---|---|---|---|
| 1101986 | 3/1961 | Fed. Rep. of Germany | 280/6.1 |

*Primary Examiner*—David M. Mitchell
*Attorney, Agent, or Firm*—Diller, Ramik & Wight

[57] ABSTRACT

This invention is related to a vehicle comprising a chassis carried by wheels or the like, a carrier (7) being arranged on said chassis and adapted to support a working equipment, such as a crane (9), said carrier being pivotable about an axis (13) extending at an angle, preferably a right angle, to the longitudinal direction of the vehicle. The vehicle comprises one or more stabilizing ground supports (14) to directly bear the vehicle against the ground. These ground supports (14) are arranged on the pivotable carrier (7). FIG. 2).

15 Claims, 3 Drawing Figures

VEHICLE

This application is a continuation, of application Ser. No. 299,032, filed Aug. 31, 1981 now abandoned.

TECHNICAL FIELD

This invention relates to a vehicle comprising a chassis carried by wheels or the like, a carrier arranged on said chassis and adapted to support a working equipment, said carrier being pivotable about an axis extending at an angle to the longitudinal direction of the vehicle, said carrier further being adapted to be connected to the vehicle during use as well as transportation of the working equipment, and means to pivot the carrier relative to the chassis about said axes to compensate for inclination of the ground.

BACKGROUND OF THE INVENTION

A vehicle of this kind is known by e.g. the Swedish patent specification No. 400 243. That vehicle is provided with piston-cylinder mechanisms acting between the carrier and the chassis of the vehicle to level the carrier about its axis. Moreover, in order to enable adjustment of the carrier, there are piston-cylinder mechanisms acting between the carrier and wheel assemblies of the vehicle, said mechanisms serving to adjust the wheel assemblies in different elevations relative to the chassis of the vehicle. Thus, the vehicle will always be supported on the ground via the wheels of the vehicle, a fact which may cause severe problems of stability due to the resiliency of the tires.

SUMMARY OF THE INVENTION

The object of the present invention is to provide the possibility to support the carrier in a very stable manner, problems of stability due to resiliency of rubber tires and wheel suspensions being avoided. In this connection, a particular object of the invention is to make it possible to support a crane arrangement of the so-called "sky-lift" type on the carrier, i.e. a crane arrangement carrying a working platform or cabin at an extremely high level, e.g. in the order of 30–40 meters.

This object is obtained in accordance with the invention in that one or more stabilizing ground supports to directly bear the vehicle against the ground are provided on the pivotable carrier.

BRIEF DESCRIPTION OF THE DRAWINGS

With reference to the appended drawings, a more specific disclosure of an embodiment according to the invention will follow hereinafter.

In the drawings.

BEST MODE OF CARRYING OUT THE INVENTION

Figure 1:
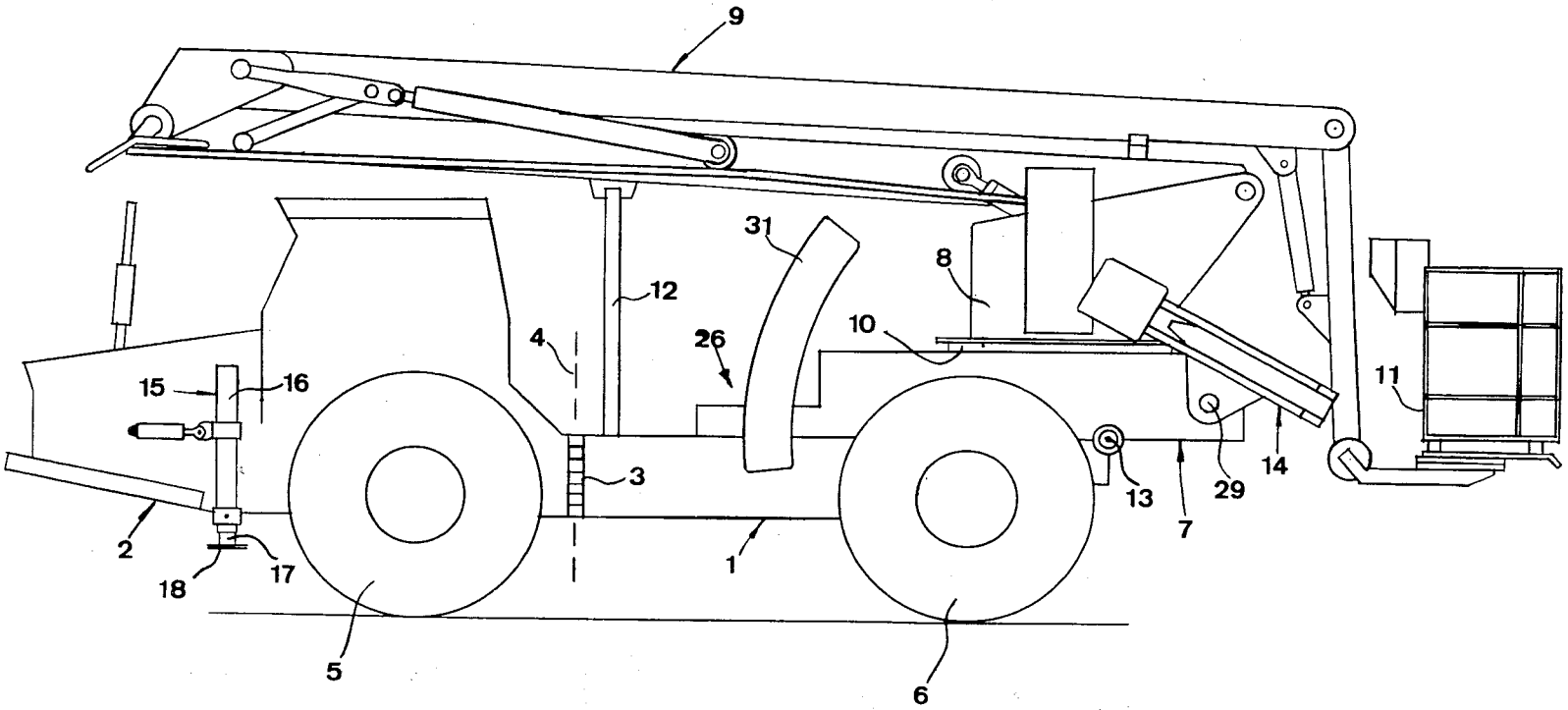
FIG. 1 is a diagrammatical sideview of the vehicle according to the invention in a position of transportation.

The vehicle illustrated in the drawings is a terrain vehicle of the type having steering ability at the center or "waist" and comprising a rear vehicle portion 1 and a forward vehicle portion 2. These vehicle portions are interconnected at the "waist" by means of a hinge 3, by means of which the two vehicle portions are pivotable relative to each other about a generally vertical axis 4. It is preferred that the vehicle portions 1 and 2 be restrained from pivoting relative to each other about a generally horizontal axis in the longitudinal direction of the vehicle. The vehicle portions each have a wheel assembly and it is preferred that all wheels are driven. When driving in the terrain, adjustment to the terrain may be obtained in that the wheel assemblies 5, 6 of the vehicle are pivotably suspended in a manner known per se.

On the rear vehicle portion 1, there is provided a carrier 7 to support a base 8 to a working equipment in the form of a crane arrangement 9 of the so-called "sky-lift" type. The base 8 is connected to the carrier 7 via a turn table 10 or other similar bearing device to enable rotation of base 8 relative to carrier 7. In practice, said axis will be vertical during working with the crane arrangement. The crane arrangement has, in the embodiment, at its outer end a working platform 11 or the like. In the transportation position illustrated in FIG. 1, the crane arrangement 9 is folded above the vehicle while the working platform 11 is located at the vicinity of the rear end of the vehicle. A bracket 12 serves to support the crane arrangement.

The vehicle illustrated in the drawings is particularly intended to enable work at a high elevation in a difficult terrain, one or more operators being located in the working cabin 11. The work may involve work on electrical distribution lines or poles therefor. Since the crane arrangement 9 has an extremely high working height, it is extremely important that the base 8 is carefully levelled or horizontal during work. The slightest instability or vibration of the vehicle will cause a movement many times greater of the working cabin when the same is raised. The requirements as to the levelling are in practice so severe that the levelling must be carried out with the assistance of water levels or similar levelling devices. So as to simplify levelling of the base 8 for the case that the vehicle is in a slope when the crane arrangement 9 is to be used, the carrier 7 is pivotable about an axis 13 directed transverally relative to the longitudinal direction of the vehicle. In order to maintain the vehicle in the working position in a stable manner during work, the vehicle comprises a number of ground supports 14, 15 to directly bear the vehicle against the ground. The ground supports are, in the embodiment, four in number and one pair of ground supports is located at the rear end of the vehicle, while a second pair of ground supports are located at the forward end of the vehicle. The ground supports in each pair are located on opposite sides of the vehicle. The forward ground supports 15 preferably consist of piston cylinder mechanisms, the cylinders 16 of which are connected to the forward vehicle portion 2 while their piston rods 17, which are movable upwardly and downwardly are connected to plate 18 for ground engagement.

The rear ground supports 14 are arranged on the pivotable carrier 7 to directly bear the same against the ground.

Figure 2:
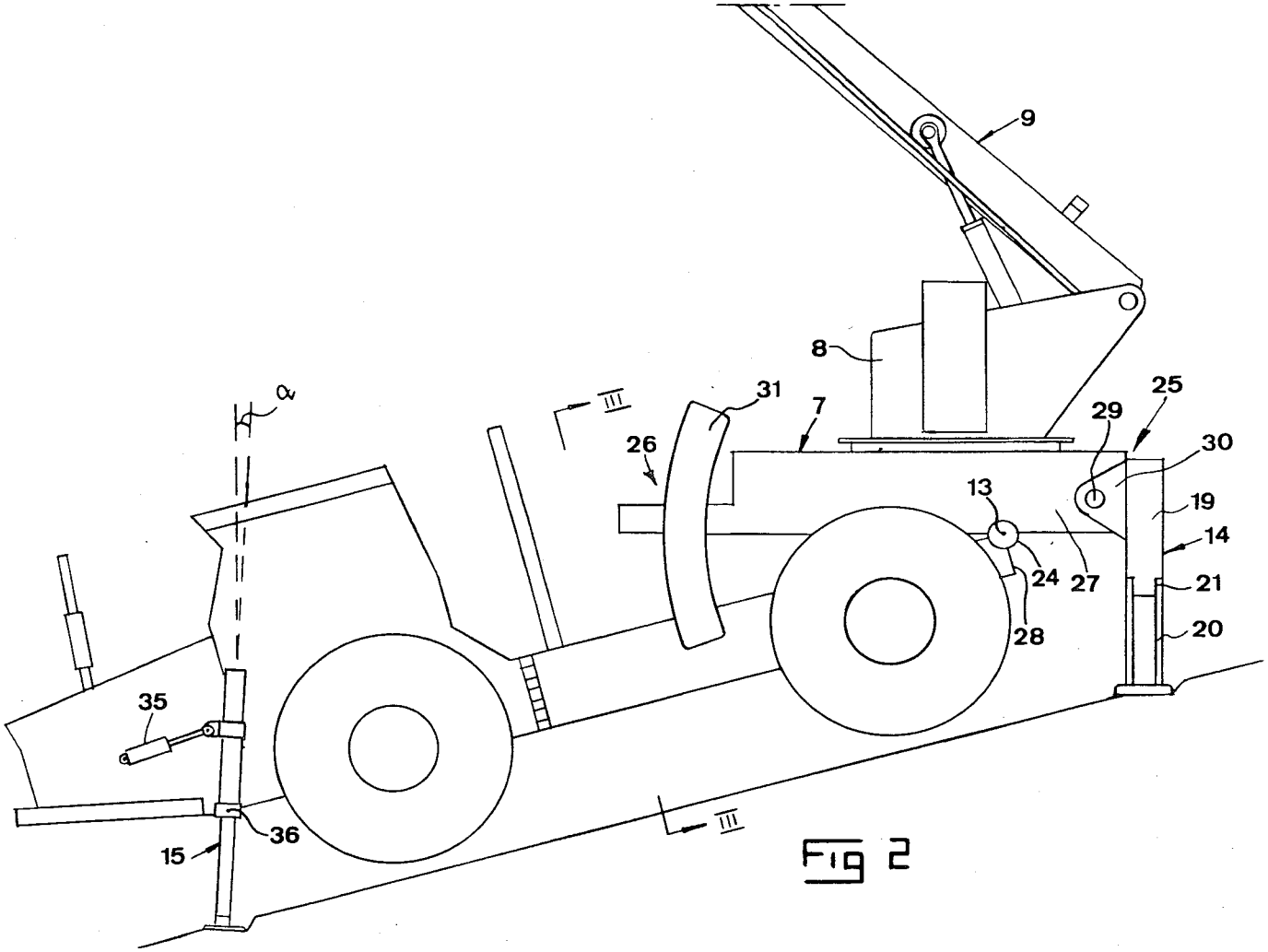
FIG. 2 is a side view of the vehicle in a working position.
Figure 3:
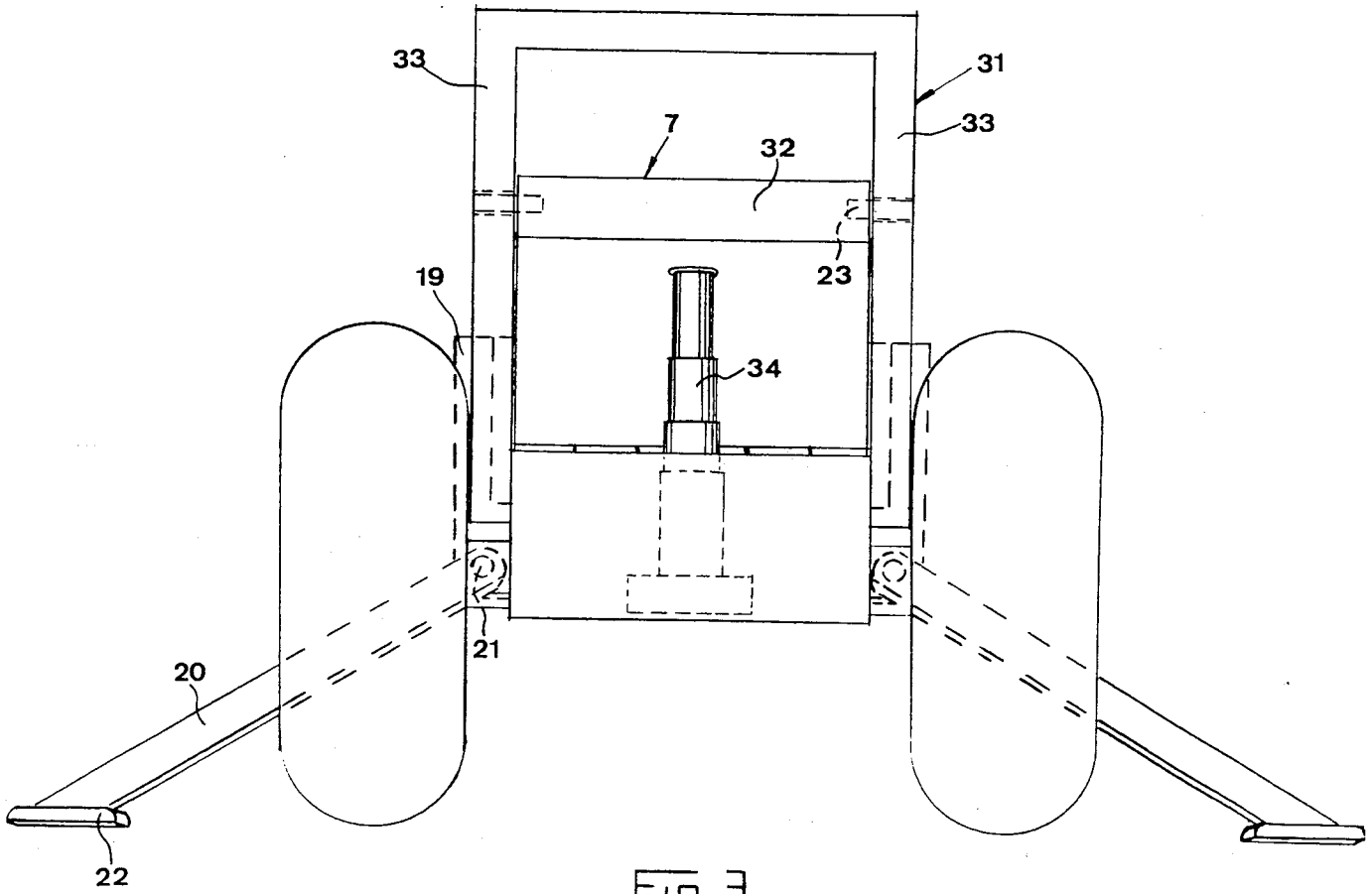
FIG. 3 is a diagrammatical section through the vehicle along the line III—III in FIG. 2, the working equipment illustrated in FIGS. 1 and 2 having been omitted in FIG. 3.

As is most clearly apparent from FIG. 3, each of the rear ground supports 14 may comprise a first portion 19 connected to the carrier 7 which is extensible and retractible relative to a second portion 20, via a hinge 21. The hinge 21 extends in the longitudinal direction of the vehicle and is connected to the first portion 19. The portion 20 has at its free end a plate 22 or the like for ground engagement. The portion 20 is by means of a piston cylinder mechanism (not illustrated) or the like pivotable between the position illustrated in FIGS. 2 and 3, in which the plate 22 of the portion bears on the ground, and the position illustrated in FIG. 1, in which the portion 20 is pivoted upwardly and extends generally vertically.

The ground supports 14, 15 on one side of the vehicle are operable independently of the corresponding ground supports on the other side of the vehicle to enable adjustment of the elevation of the vehicle. As is apparent from FIG. 2, the ground supports are adapted to entirely lift the vehicle so that the wheels thereof no longer have contact with the ground.

The ground supports 14 are arranged to exert their supporting influence on the carrier 7 at the rear end thereof, as is clearly apparent from FIG. 2. The carrier is at its forward end securable in different pivotal positions relative to the chassis of the vehicle by means of locking means 23 in a manner which will be described later. The hinge 24 forming the pivot axis 13 for carrier 7 is, as viewed in the longitudinal direction of the vehicle, located between the area 25 of the carrier, in which the ground supports 14 exert their supporting action, and the area 26 of the carrier, in which the carrier is securable to the chassis of the vehicle.

A portion 27 of carrier 7 projects rearwardly past the rear end 28 of the chassis of the vehicle and the ground supports 14 are adapted to exert their stabilizing action on this projecting carrier portion 27. The ground supports 14 are, as appears by FIGS. 1 and 2, pivotably connected to carrier 7 about an axis 29 extending generally parallel to pivot axis 13 for carrier 7. More specifically, the portions 19 of the ground supports have an ear 30 protruding in the longitudinal direction of the vehicle, said ear having an aperture for the reception of the shaft 29. In order to rotate each of the ground supports 14 about its shaft 29, a piston cylinder mechanism may be provided, by means of which the ground support may be adjusted into different positions of rotation. In addition, a mechanical locking device may be provided to obtain locking of the ground support with additional safety. More specifically the ground support is rotatable between the active position illustrated as an example in FIG. 2 and the position illustrated in FIG. 1, in which the ground support 14 is rotated upwardly to avoid that the lower end of the ground support contacts the ground during transportation. It is to be noted that the working cabin 11 during transportation may be raised somewhat from the position illustrated in FIG. 1 in order to increase the rear angle of clearance of the vehicle. Moreover, it is to be noted that the ground supports 14 may be rotated about axis 29 so that they in use may slope (e.g. up to 5°) in a direction away from axis 13.

As appears by FIGS. 1 and 2, also the forward ground supports 15 may be rotatable (by means of the cylinder 35) about an axis 36 analogous and parallel to axis 29, whereby the ground supports 15 e.g. may be adjusted so that they in use extend generally vertically or, as illustrated in FIG. 2, are somewhat inclined relative to a vertical plane. In the position according to FIG. 2, the ground supports are inclined towards the ground supports 14 in order to improve stability. The angle of inclination $\alpha$ may e.g. be up to 5°.

A guide 31 is arranged at a distance from the pivot axis 13 of carrier 7 and at the forward end of the carrier, said guide exerting a guiding influence on the carrier 7 during the pivotal movement thereof and when the carrier is in its different positions. As is most clearly apparent from FIG. 3, the guide 31 is generally inversely U-shaped and the guide is receiving a portion 32 of the carrier between the branches 33 of said U. As appears by FIG. 2, the guide 31 may have, as viewed from the side of the vehicle, a curved shape with a radius of curvature corresponding to the distance to axis 13. In order to obtain efficient guiding of carrier 7, the portion 32 thereof abuts via suitable slide bearing elements against the inner sides of the branches 33 of the guide. In FIG. 3, a piston cylinder mechanism 34 adapted to pivot carrier 7 about axis 13 is also illustrated, said mechanism acting between the carrier 7 and the chassis of vehicle portion 1. The piston cylinder mechanism 34 is located in the area of guide 31 and the forward end of the carrier. In order to obtain a distinct mechanical locking of carrier 7 in desired pivotal positions, there may e.g. be used pins 23, which project through apertures in the branches 33 of the guide and extend into apertures in the sides of carrier portion 32. It is to be understood that a plurality of apertures for pins 23 are provided in branches 33.

The vehicle according to the invention is used as follows: During driving on roads for transportation or in the terrain, the ground supports 14, 15 are, as appears by FIG. 1, folded and carrier 7 is locked to vehicle portion 1 in the position illustrated. When the vehicle has reached the place where the crane arrangement 9 is to be used for work, carrier 7 is pivoted about axis 13 by the piston cylinder mechanism 34 so that carrier 7 achieves a position as horizontal as possible, whereafter carrier 7 is locked in said position by means of pins 23. It is to be understood that a rough adjustment of carrier 7 is obtained by means of pins 23. Thereafter, the ground supports 14 are pivoted to the position according to FIG. 2, so that they engage the ground with their plates 22 and 18 respectively. The ground supports 14 and 15 are now used to obtain a fine adjustment of the vehicle and the position of carrier 7 by means of water level or similar measuring equipment so that carrier 7 is located in the correct position, namely that position, in which the axis of the turntable 10 is as close to vertical as possible. Possible side inclinations of the vehicle are thereby eliminated through the ground supports in that the ground supports located on one side of the vehicle may be used to lift one side of the vehicle more than the other side of the vehicle is lifted by the other ground supports. In an analogous manner, the ground supports at the rear and forward end of the vehicles may be operated in pairs so that the ends of the vehicle are raised and lowered respectively. When the carrier 7 has been adjusted into the desired position, the crane arrangement may be operated as desired. It is to be mentioned that it is preferable to have the crane arrangement 9 to work rearwardly in relation to the vehicle since the forward portion of the vehicle then will serve as a counter weight. For reasons of stability, it is of course also preferable to locate the vehicle so that the rear end thereof is located higher than the forward end of the vehicle during work in slopes. Thus, use of the possibility to pivot carrier 7 when working in a slope is illustrated in FIG. 2; if the ground would be generally planar, carrier 7 may of course remain in the position illustrated in FIG. 1 during the work.

The advantages of the invention are evident in that the same enables work with crane arrangements or the like requiring extremely careful adjustment, also in terrain with comparatively large inclination. Since the rear ground supports 14 are provided directly on the pivotable carrier 7 and the carrier moreover is locked (by means of the piston cylinder mechanism 34 and/or pins 23) at a distance from the ground supports, an extremely good stability of carrier 7 is obtained and the vehicle entirely lifted from the ground will "depend" via the hinge 24 under carrier 7 so that the stability is additionally improved thereby. The strenght of the hinge 24 may not be as great as if the ground supports 14 would be arranged on the chassis of the vehicle portion 1 instead of on carrier 7. The requirements as to accuracy of the hinge 24 need not either be particularly severe and the strains on carrier 7 will be less through the arrangement of ground supports 14. An additional advantage with the provision of the ground supports 14 on carrier 7 is that said ground supports may be very easily applied on the carrier without need arises for the chassis of vehicle portion 1 to present portions extending far rearwardly and sidewardly to carry the ground supports; as appears by the drawings, the chassis of the vehicle portion 1 may instead extend much less in a direction rearwardly than carrier 7 so that the ground supports 14 will be located entirely behind the chassis of vehicle portion 1.

The invention is of course not limited to the embodiment described. Thus, several modifications of the invention are possible within the scope of the appended claims. The ground supports 14 may be rigidly, i.e. non-rotatably, connected to carrier 7. Any suitable power means may be used to operate the ground supports 14 so as to obtain a lifting force on the carrier 7 and the vehicle. The forward ground supports 15 may be provided on the forward end of the rear vehicle portion 1 instead of on the forward vehicle portion 2.

What is claimed is:

1. A vehicle comprising a chassis carried by wheels (5,6), a carrier (7) arranged on said chassis and adapted to support a working equipment (9), said carrier being pivotable by a hinge (24) about an axis (13) extending at an angle to the longitudinal direction of the vehicle, said carrier further being adapted to be connected to the vehicle during use as well as transportation of the working equipment, and power means (34) acting between the carrier and the chassis to pivot the carrier relative to the chassis about said axis to compensate for inclination of the ground, one or more stabilizing ground supports (14) to directly bear the vehicle against the ground being provided on the pivotable carrier (7), characterized in that the hinge (24) forming the pivot axis (13) of the carrier (7) is, as viewed in the longitudinal direction of the vehicle, located between a rear end area (25) of the carrier, in which the ground supports (14) exert their bearing action, and a front end area (26) of the carrier, said vehicle being defined by rear and forward vehicle portions (1, 2) interconnected by a hinge (3) having a generally vertical axis (4), said vehicle portions being restrained from rotating relative to each other about an axis extending in the longitudinal direction of the vehicle, said carrier (7) being provided on the rear vehicle portion (1), and said forward vehicle portion (2) being provided with at least another stabilizing ground support (15) to directly bear said forward vehicle portion against the ground.

2. A vehicle according to claim 1 characterized in that the ground supports (14, 15) are operable independently of each other to enable adjustment of the elevation of the vehicle.

3. A vehicle according to claim 1 characterized in that the first mentioned ground supports (14) are arranged to exert their bearing action on the carrier (7) at the rear end thereof.

4. A vehicle according to claim 3, characterized in that the carrier (7) at its forward end is securable in different pivotal positions relative to the chassis of the vehicle by means of locking means (34, 23).

5. A vehicle according to any one of claims 1, 2, 3, or 4, characterized in that a portion (27) of the carrier (7) projects rearwardly past the rear end (28) of the chassis and that the ground supports (14) provided on the carrier (7) are adapted to exert their stabilizing action on said projecting carrier portion (27).

6. A vehicle according to any one of claims 1, 2, 3, or 4, characterized in that the ground supports (14) provided on the carrier (7) are rotatable relative to the carrier about an axis (29) extending generally parallel to the pivot axis (13) of the carrier and securable in different rotational positions.

7. A vehicle according to any one of claims 1, 2, 3, or 4, characterized in that a guide (31) is provided at a distance from the pivot axis (13) of the carrier and exerts a guiding action on the carrier during the pivotal movement thereof.

8. A vehicle according to claim 7, characterized in that the guide (31) is generally inversely U-shaped and receives a portion (32) of the carrier between the branches (33) of said U.

9. A vehicle according to claim 7, characterized in that the carrier (7) is at least in part located vertically above the chassis.

10. A vehicle comprising a chassis having a longitudinal axis and formed and rear ends, wheel means for effecting mobility of said chassis along the ground, a carrier disposed upon said chassis, said carrier having forward and rear ends, means at said chassis rear end for pivoting said carrier thereto between said carrier forward and rear ends along an axis transverse to said longitudinal axis, said carrier being adapted to support working equipment thereupon and said chassis being adapted for connection to a vehicle to transport said carrier and associated working equipment, power means operative between said carrier and chassis for pivoting said carrier relative to said chassis to compensate for inclination of the ground, ground engaging stabilizing support means carried by said carrier rear end for engaging the ground to effectively stabilize said carrier and the associated chassis, said carrier being a generally platelike structure having a generally horizontal extent with said carrier forward end being positioned atop said chassis and said carrier rear end projecting rearwardly beyond said chassis rear end, and said power means being connected to said carrier at said carrier forward end and to said chassis forward of said pivoting means.

11. The vehicle as defined in claim 10 including further ground engaging stabilizing support means carried by said vehicle forwardly of said first-mentioned ground engaging stabilizing support means and therewith cooperative for jointly and in unison entirely lifting said vehicle so as to bring said wheel means completely out of contact with the ground.

12. The vehicle as defined in claim 10 including means for pivoting said stabilizing support means to said carrier rear end for pivoting movement about an axis transverse to said longitudinal axis, wherein said transverse axes are disposed in generally parallel relationship to each other, and said ground engaging stabilizing support means further includes first and second relatively extensible and contractable portions.

13. The vehicle as defined in claim 10 wherein said stabilizing support means includes first and second relatively extensible and contractable portions, and means for pivotally connecting one of said portions relative to the other of said portions whereby said stabilizing support means can be moved to an out-of-the-way position when not in engagement with the ground.

14. The vehicle as defined in claim 11 wherein said further ground engaging stabilizing support means includes a first portion pivotally connected to said vehicle about an axis disposed generally parallel to the carrier pivoting means transverse axis and a second portion connected to said first portion and movable upwardly and downwardly with respect thereto.

15. The vehicle as defined in claim 12 including means for pivotally connecting said extensible and contractable portions to each other for pivoting about an axis correponding to the longitudinal axis of said chassis.

* * * * *